US008216077B2

(12) United States Patent
Bussink et al.

(10) Patent No.: US 8,216,077 B2
(45) Date of Patent: Jul. 10, 2012

(54) OBSERVATION WHEEL TYPE RIDE

(75) Inventors: Ronald Alexander Bussink, Zug (CH); Stephan Lins, Feldkirch (AT); Johannes Fraundorfer, Wolfurt (AT)

(73) Assignee: Ronald Bussink Amusement Design GmbH, Dusseldorf (DE)

( * ) Notice: Subject to any disclaimer, the term of this patent is extended or adjusted under 35 U.S.C. 154(b) by 0 days.

(21) Appl. No.: 12/773,385

(22) Filed: May 4, 2010
(Under 37 CFR 1.47)

(65) Prior Publication Data

US 2011/0207539 A1 Aug. 25, 2011

Related U.S. Application Data

(60) Provisional application No. 61/175,606, filed on May 5, 2009.

(30) Foreign Application Priority Data

May 5, 2009 (EP) ..... 09006123

(51) Int. Cl.
*A63G 27/08* (2006.01)
*A63G 27/00* (2006.01)

(52) U.S. Cl. ..... 472/30; 104/173.1

(58) Field of Classification Search ..... 472/3, 29–30, 472/32, 44, 45, 136; 104/53, 165, 173.1
See application file for complete search history.

(56) References Cited

U.S. PATENT DOCUMENTS

| | | | | |
|---|---|---|---|---|
| 2,423,283 | A * | 7/1947 | Austin | 472/16 |
| 2,590,934 | A * | 4/1952 | Catlett | 472/3 |
| 2007/0113753 | A1 | 5/2007 | Meindl et al. | |

FOREIGN PATENT DOCUMENTS

| | | |
|---|---|---|
| EP | 1 790 402 A1 | 5/2007 |
| GB | 06510 | 0/1909 |
| GB | 255700 | 7/1926 |

* cited by examiner

*Primary Examiner* — Kien Nguyen
(74) *Attorney, Agent, or Firm* — Henry M. Feiereisen; Ursula B. Day

(57) ABSTRACT

An observation wheel type ride includes a support structure, a wheel which is rotatable mounted in the support structure and/or includes a transportation device movably supported on the wheel, and a drive mechanism. The drive mechanism includes a rotary drive and a drive cable, wherein a section of the drive cable is detachably fixed to a circumference of the wheel and/or to the transportation device for transmitting the rotary movement of the rotary drive to the wheel and/or to the transportation device. A deflection assembly deflects in a lateral direction with respect to the wheel that section of the drive cable, which is led over the rotary drive.

20 Claims, 8 Drawing Sheets

OBSERVATION WHEEL TYPE RIDE

CROSS-REFERENCES TO RELATED APPLICATIONS

This application claims the benefit of prior filed U.S. Provisional Application No. 61/175,606, filed May 5, 2009, pursuant to 35 U.S.C. 119(e).

This application claims the priority of European Patent Application, Serial No. 09 006 123.5, filed May 5, 2009, pursuant to 35 U.S.C. 119(a)-(d).

The contents of U.S. Provisional Application No. 61/175,606 and European Patent Application, Serial No. 09 006 123.5 are incorporated herein by reference in their entirety as if fully set forth herein.

BACKGROUND OF THE INVENTION

The present invention relates to an observation wheel type ride.

The following discussion of related art is provided to assist the reader in understanding the advantages of the invention, and is not to be construed as an admission that this related art is prior art to this invention.

Observation wheels or giant wheels are common in cities and on fairgrounds. Due to their height and their slow movement they generally provide an impressive view over the surrounding area.

Conventional observation wheels usually include a fixed support structure and a wheel, which is rotatably mounted in the support structure. The mounting is usually accomplished by a central axle or shaft, which is supported in corresponding bearings of the support structure. The wheel further includes an annular construction, generally designated as "ring", which supports a plurality of passenger seats or cabins. The connection between the annular structure and the central axle or spindle is usually accomplished by a plurality of connecting bars or steel cables, generally designated as "spokes".

Some observation wheels are designed to have the rotary drive act directly on the central shaft of the wheel or on the annular construction with one or several synchronized drives. Other observation wheels, in particular the larger ones, use a cable, e.g. steel cable, which is fixed to the circumference of the wheel and connected to a rotation drive, which is situated in the support structure below the wheel. The rotary drive acts on the cable via a drive pulley in order to move the wheel.

European Patent Document EP 1 790 402 A1 discloses a drive mechanism for an observation wheel. Although this observation wheel is particular in that it does not have a movable wheel but a fixed annular structure, on which the moving passenger gondolas, which are interconnected with each other by connecting cables, are guided on rails, the drive mechanism is identical to the aforementioned cable drive system of conventional observation wheels. The cable drive system of European Patent Document EP 1 790 402 A1 includes a steel cable, which frictionally engages on rolls of each of the gondolas, thereby moving the gondolas along the rails of the annular structure. The rotational drive of the observation wheel is located directly underneath the annular structure and includes two drive pulleys which are mounted on a single driveshaft of the motor. The steel cable, which runs on both sides along the circumference of the annular structure, is deflected by the drive pulleys in such a way that the cable is constantly changing from side to side. In order to be guided to the drive mechanism, the steel cable, in the lower part of the annular structure, is led away from the circumference of the annular structure in the tangential direction.

The cable drive system according to European Patent Document EP 1 790 402 A1 is disadvantageous in that it requires that the drive mechanism is located directly underneath the annular structure. Further, this design of a drive mechanism requires that the maximum width of the gondolas is less than the distance between the two loops of the driving steel cable, i.e. less than the width of the annular structure, in order to avoid a collision of the gondolas with the tangentially led away section of the steel cable.

It would therefore be desirable and advantageous to provide an improved observation wheel like ride to obviate prior art shortcomings.

SUMMARY OF THE INVENTION

According to one aspect of the present invention, an observation wheel type ride includes a support structure, a wheel which is either rotatably mounted in the support structure and/or which includes transportation means (in particular passenger transportation means), which are movably supported on the wheel, a drive mechanism including a rotary drive and a drive cable, the drive cable having a section which is detachably fixed to a circumference of the wheel and/or the transportation means for transmitting a rotary movement of the rotary drive to the wheel and/or the transportation means, and deflection means for deflecting in a lateral direction with respect to the wheel the section of the drive cable, which is led over the rotary drive.

Due to the deflection of the cable in the sideways or lateral direction, a collision of the passenger cabins can be avoided even if the cabins project over the lateral end of the wheel and the loop of the drive cable, which is affixed to the wheel. This allows a design of the passenger cabins, which is not limited by the lateral dimensions of the wheel. Further, as the drive cable is deflected sideways before entering the rotary drive, the observation wheel like amusement ride according to the invention allows for a location of the rotary drive adjacent to the wheel. Thus, a positioning of the rotary drive directly underneath the wheel is not necessary. In comparison with classical drive systems made of several synchronized drives, the observation wheel according to the invention may be used with a single drive and thus does not require a synchronizing of several drives, which is known as a problem.

To ensure clarity, it is necessary to establish the definition of several important terms and expressions that will be used throughout this disclosure.

The term "wheel" is not limited to a circular shape, but may have a shape other than circular, e.g. an elliptical, rectangular, hexagonal, octagonal, etc. shape.

The term "rotary drive" relates to any drive which allows a continuous movement of the cable.

The term "cable" relates to any force-transmitting means flexible enough to be guided in a loop along the circumference of the wheel and through the drive mechanism. This may include any suitable ropes, (steel) cables, chains, etc.

The term "circumference of the wheel" is not limited to a circumferential outside edge of the wheel but may be any ring-shaped area that encircles the gravitational or rotational centre of the wheel.

According to another advantageous feature of the present invention, the deflection means may include at least one deflection pulley for deflecting the cable in a lateral direction with respect to the wheel. A deflection pulley allows for a low frictional deflection of a cable in almost any direction. Deflection pulleys may be provided on both sides of the annular structure in order to lead away the cable from the circumference of the annular structure.

According to another advantageous feature of the present invention, the rotary drive has a drive pulley for guiding the drive cable, with the deflection means including two additional guide pulleys arranged between the deflection pulley and the drive pulley. The two guide pulleys may be provided to deflect the drive cable again, which allows for a positioning of the drive pulley parallel or almost parallel to the wheel.

In case two deflection pulleys are used, one may be provided to deflect an incoming section of the drive cable while the other one of the deflection pulleys may be provided to deflect an outgoing section of the drive cable. Each of the drive pulleys may be provided with a circumferential groove into which the drive cable engages in order to be securely guide by the deflection pulley. The two deflection pulleys may be supported by separate shafts or they may be supported by a single shaft in a way that an independent rotation of the two deflection pulleys with respect to each other is provided. Instead of a single shaft two collinear shafts may be suitable as well.

In case only one deflection pulley is provided, this deflection pulley may be provided with two grooves, advantageously in parallel relationship, wherein one of the grooves is provided to guide the incoming section of the drive cable, while the other groove is provided for guiding the outgoing section of the drive cable. It is self-evident, that two deflection pulleys, which are arranged on top of each other and which are supported by the same axle or by two collinear axles are equivalent to a single deflection pulley with two grooves.

According to another advantageous feature of the present invention, the cable may frictionally engage the circumference of the wheel and/or with a part of the transportation means in order to transmit the driving force from the cable to the wheel and/or to the transportation means. Of course, a form-locking engagement of the cable and the wheel and/or the transportation means may be possible as well.

According to another advantageous feature of the present invention, the cable may frictionally engage in a plurality of cable shoes, which can be distributed, preferably evenly, along the circumference of the wheel and/or the transportation means. This allows for a simple structural connection of the cable and the wheel and/or the transportation means.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
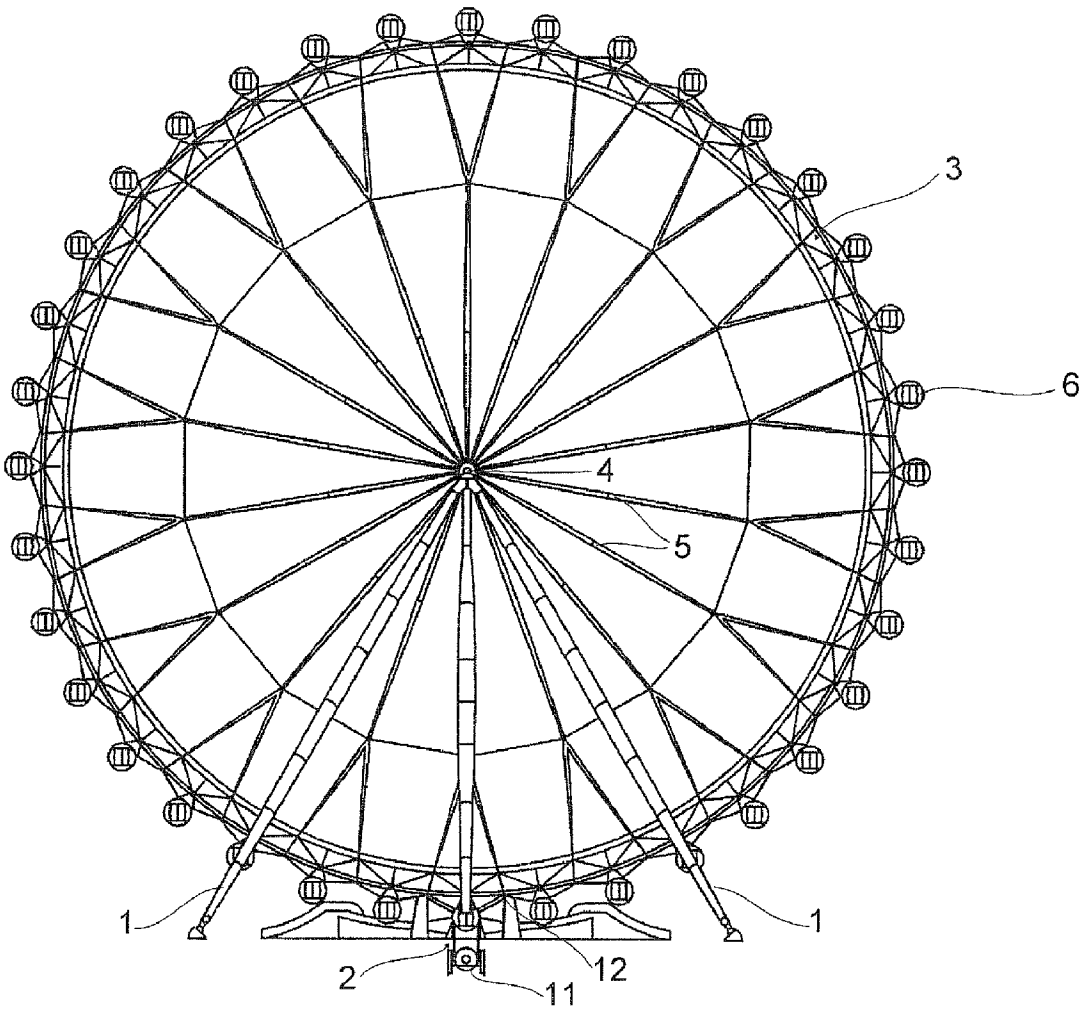
FIG. 1: is a rear view of a first embodiment of an observation wheel according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a rear view of a first embodiment of an observation wheel according to the present invention. The observation wheel shown is a stationary observation wheel, i.e. it is designed to be situated in the same location for the whole operation time. It is self-evident, that also movable observation wheel like rides can be designed according to the invention.

The observation wheel includes a support structure, which is composed of five columns 1. Each of the five columns 1 extends from a foundation 2 in the ground to the centre of a generally circular wheel. The wheel includes an annular framework 3 which is connected to a central shaft 4 by a plurality of connecting rods 5. The central shaft 4 is mounted in respective bearings at the top end of the five columns 1 and represents the rotational axis of the wheel.

Figure 3:
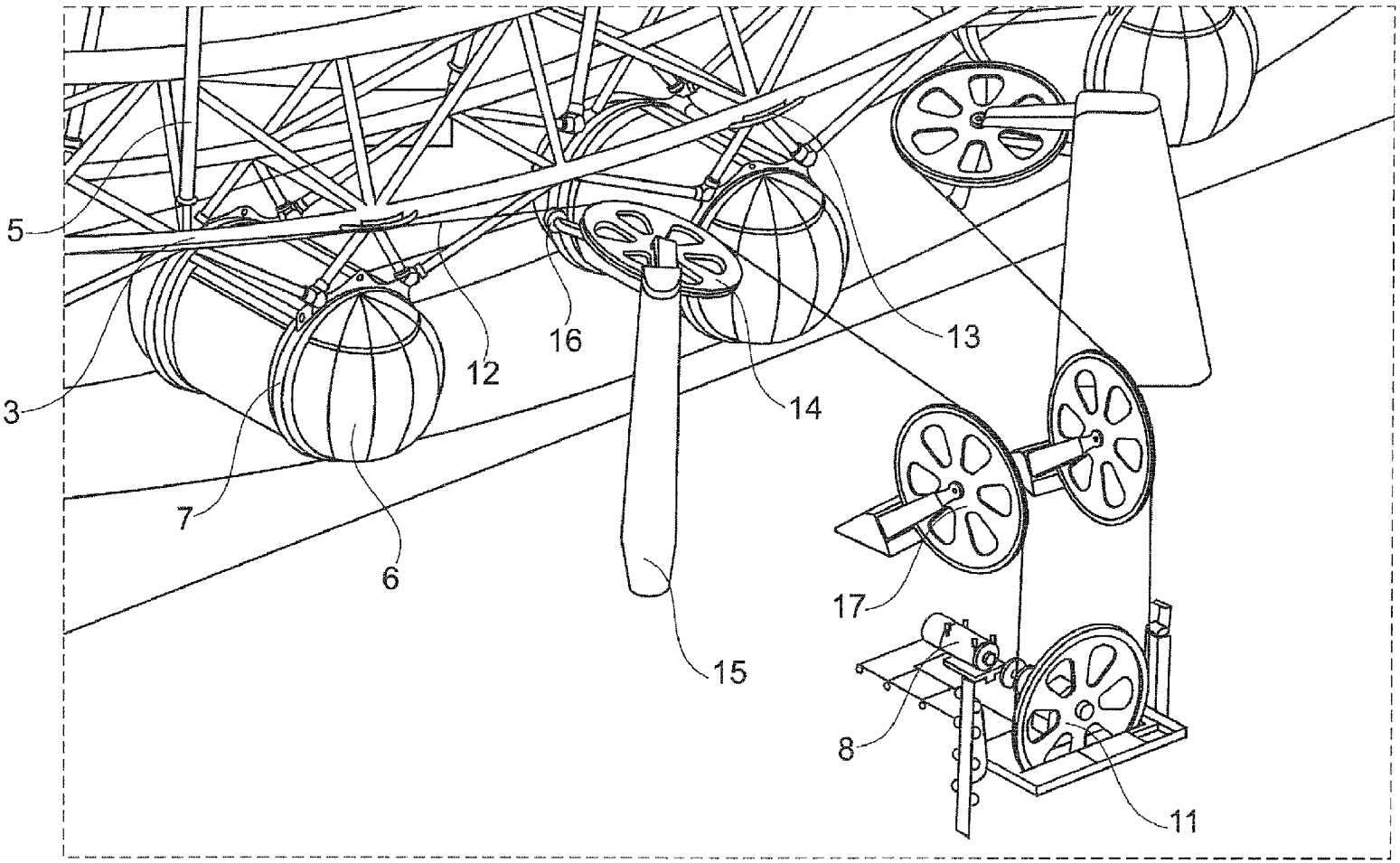
FIG. 3: is an isometric view of the lower section of the observation wheel of FIG. 1.
Figure 4:
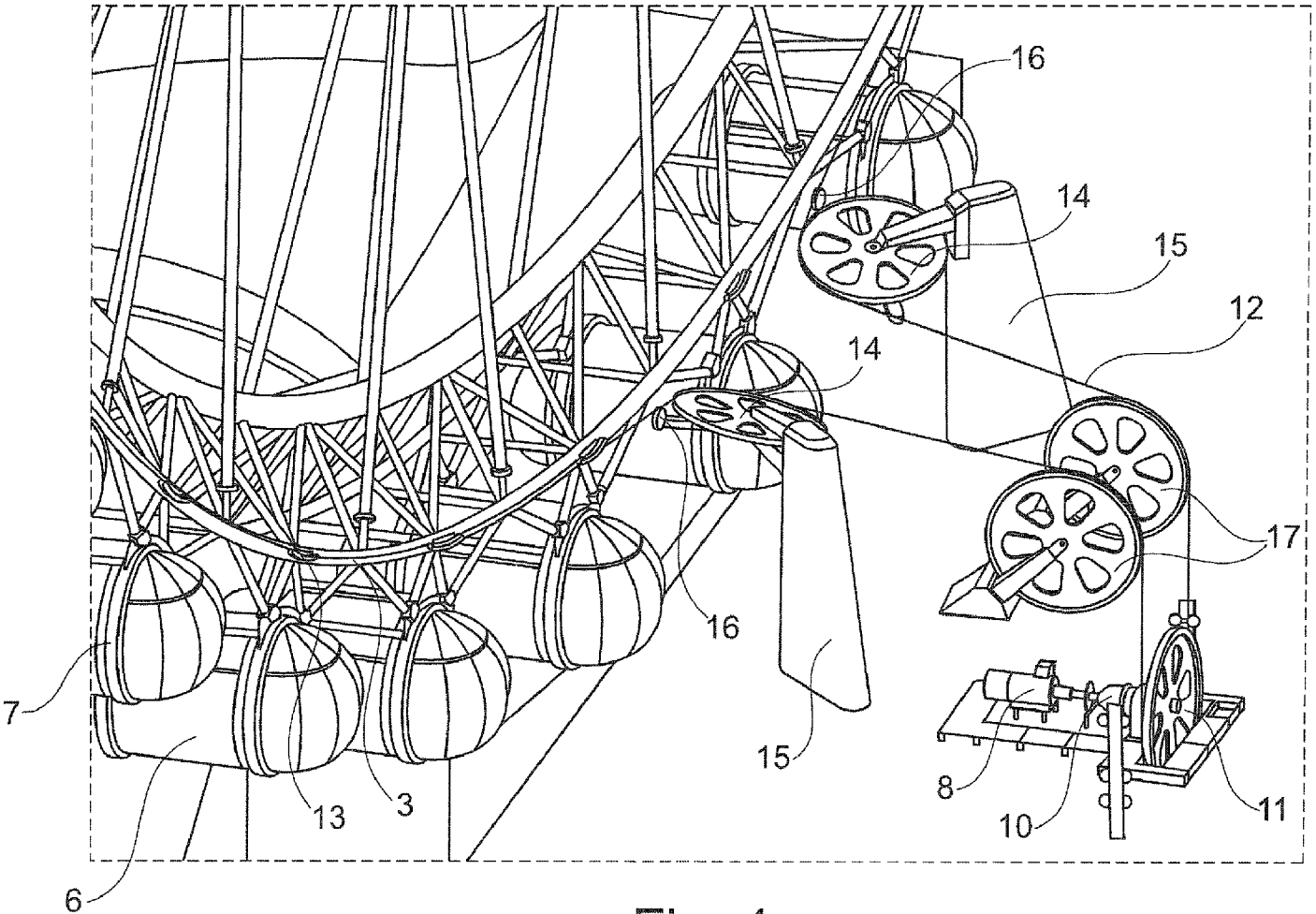
FIG. 4: is another isometric view of the lower section of the observation wheel of FIG. 1.
Figure 5:
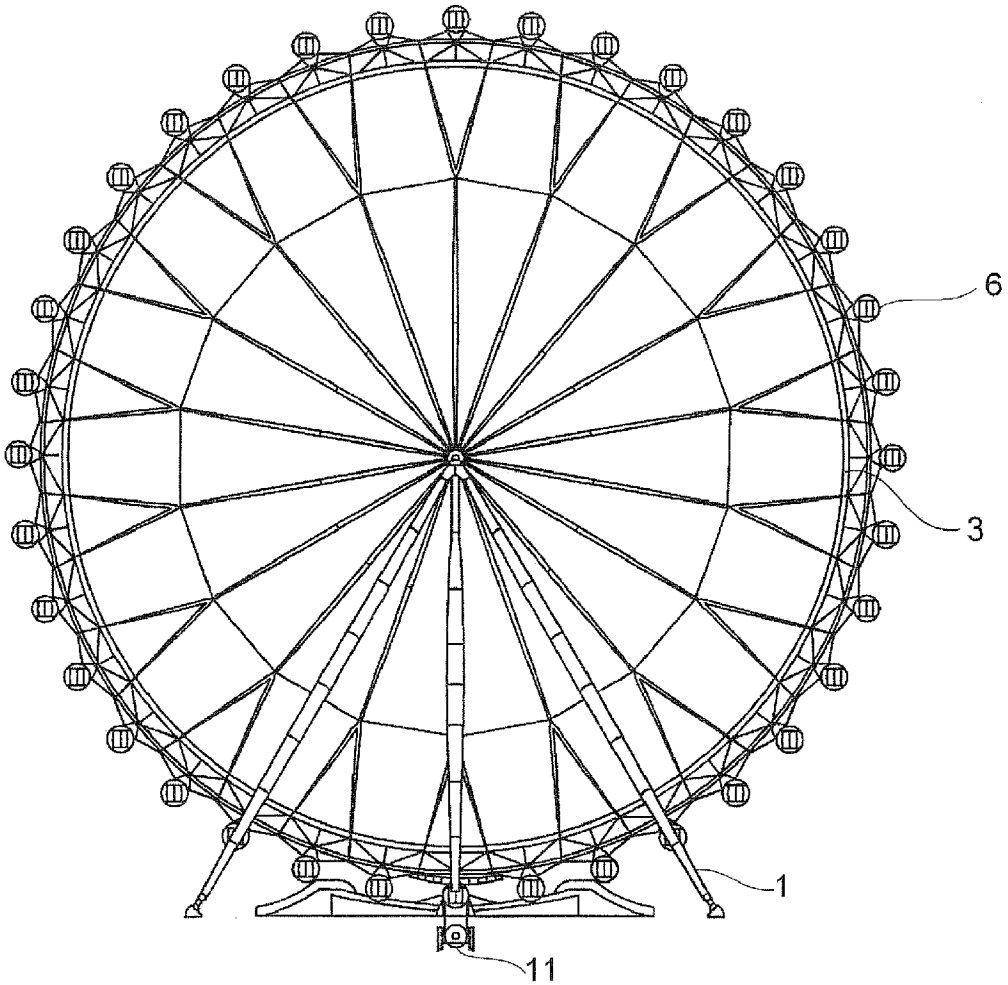
FIG. 5: is a rear view of a second embodiment of an observation wheel according to the present invention.
Figure 6:
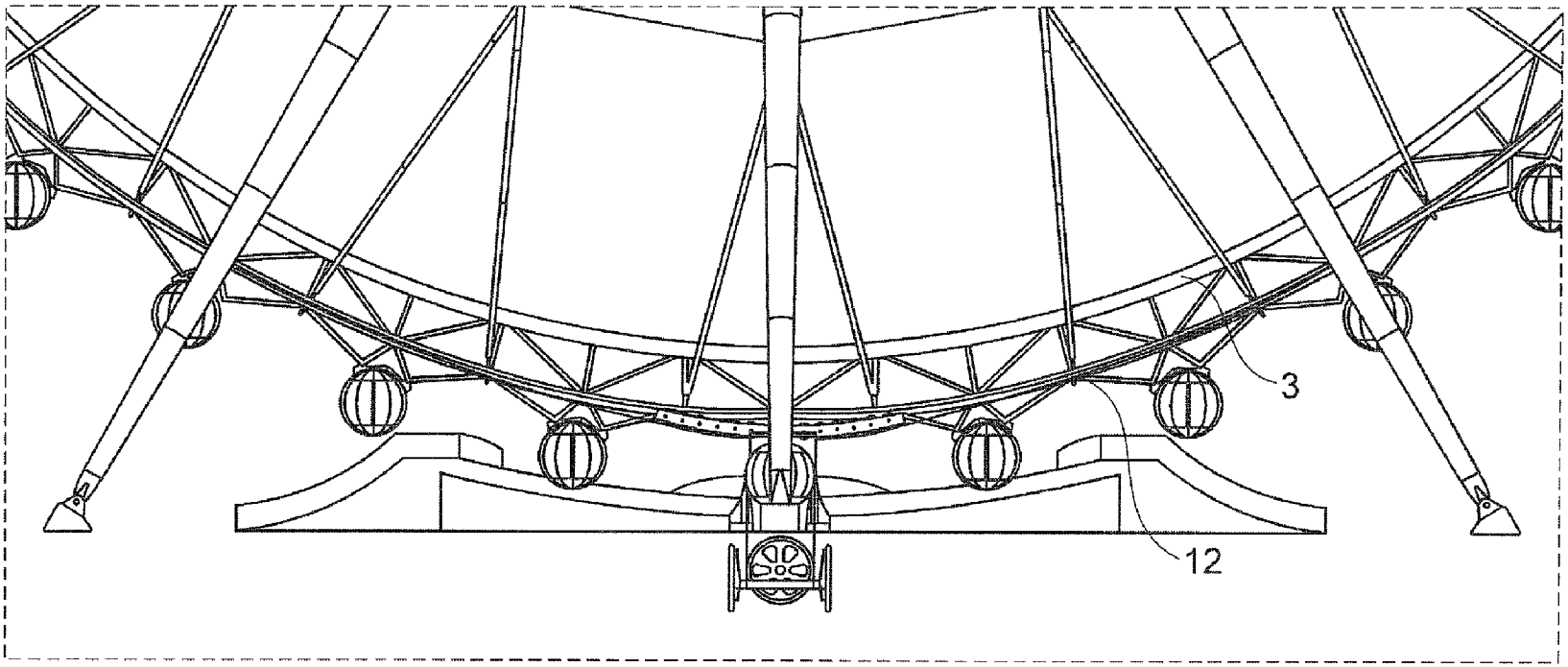
FIG. 6: is a rear view of a lower section of the observation wheel of FIG. 5.
Figure 7:
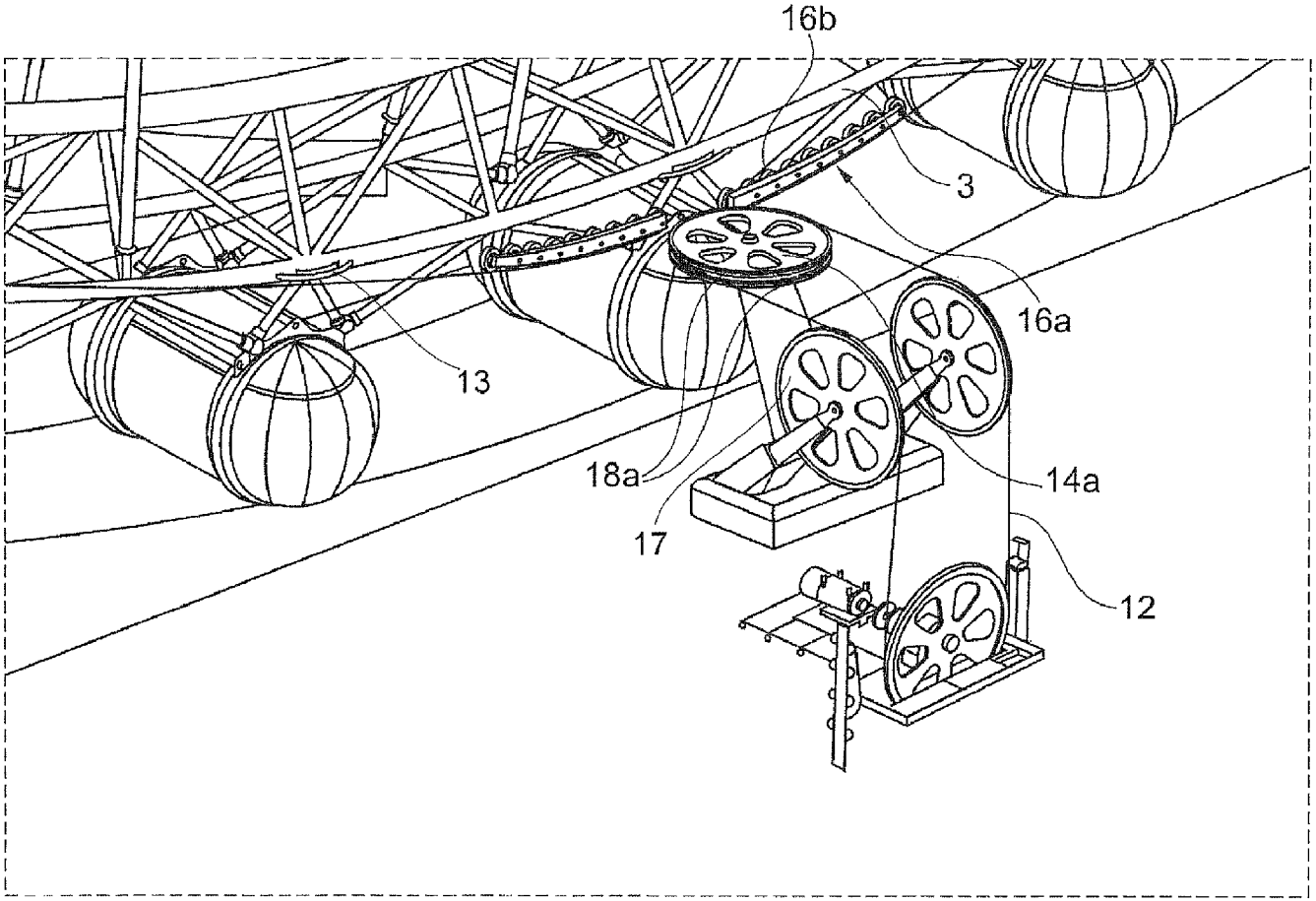
FIG. 7: is an isometric view of the lower section of the observation wheel of FIG. 5.
Figure 8:
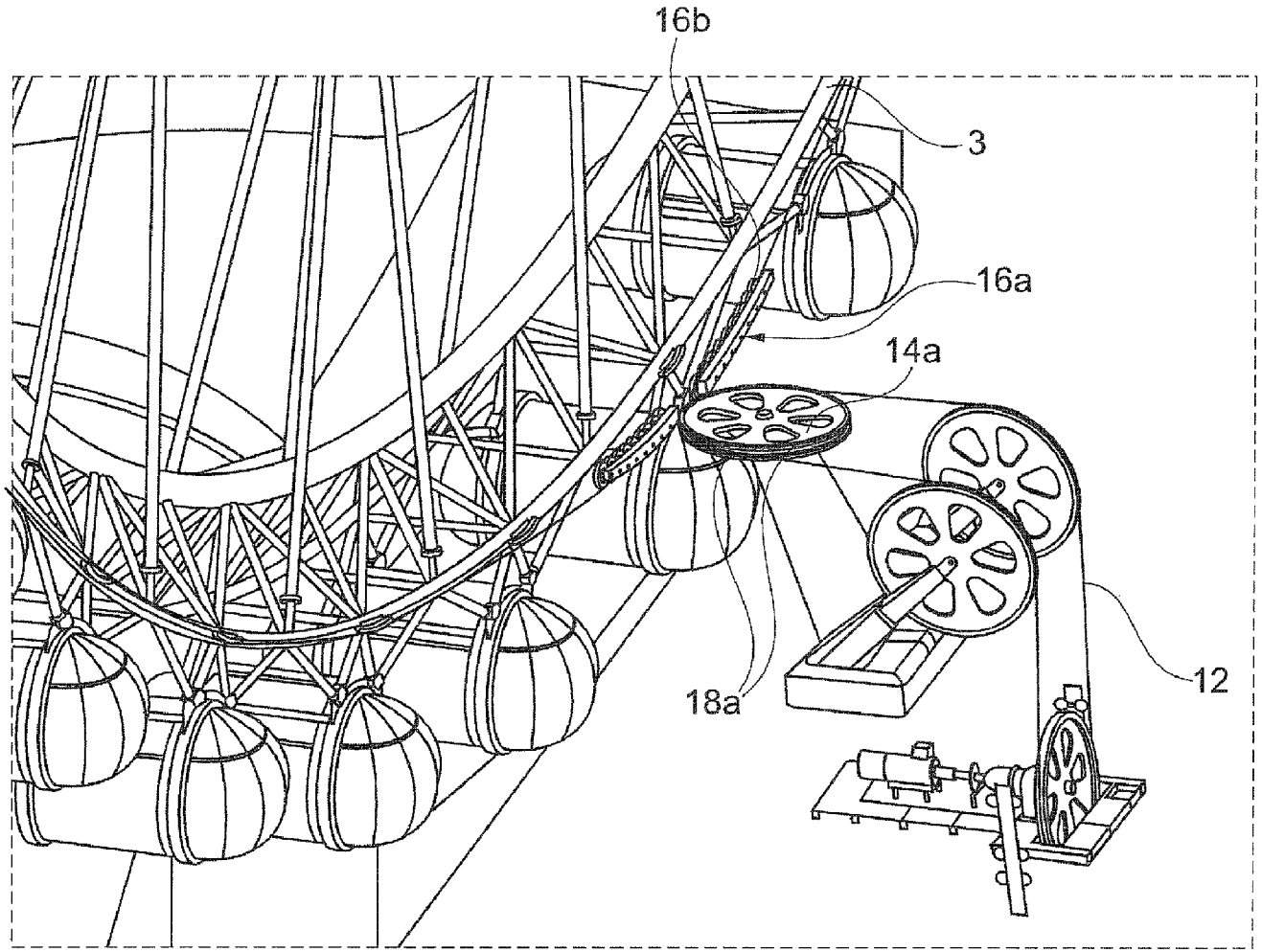
FIG. 8: is another isometric view of the observation wheel of FIG. 5.

A plurality of passenger cabins 6 are evenly distributed along and attached to the outside of the annular framework 3. The passenger cabins 6 have an elongated shape, as shown in FIGS. 3 and 4, with their longitudinal axis being parallel to the central shaft 4 of the wheel. Each passenger cabin 6 provides space for a plurality of passengers and includes a steel base and a steel ceiling and walls made of glass to provide an almost undisturbed view over 360°. The passenger cabins 6 are mounted to the outside of the annular framework 3 in a way that allows for a free rotation about their longitudinal axes. This is accomplished by two annular bearings 7 per cabin 6. Alternatively, the cabins 6 may be rotationally driven or self-rotating.

Figure 2:
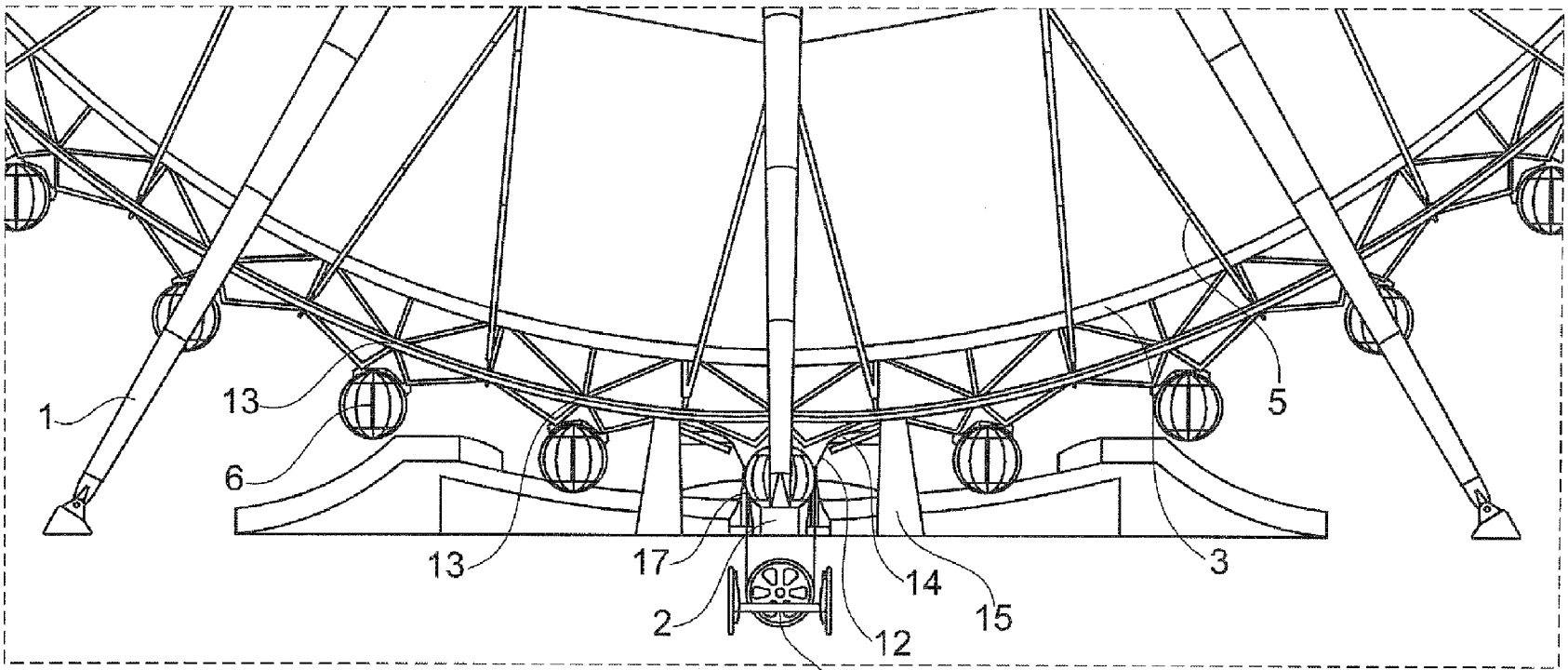
FIG. 2: is a rear view of a lower section of the observation wheel of FIG. 1.

The wheel is rotationally driven by a drive mechanism which is shown in greater detail in FIGS. 2 to 4 and includes an electric motor 8, which is situated in a subterraneous engine room. The electric motor 8 is horizontally aligned (different angles are possible) and acts via a gear box 10 on a drive pulley 11, which is vertically aligned. The rotational movement generated by the electric motor 8 is transferred to the wheel by a steel cable 12 which is guided along a plurality of cable shoes 13, which are evenly distributed along the circumference of the annular framework 3.

Arranged at the bottom of the wheel are two deflection pulleys 14 which are mounted on separate supports 15. The deflection pulleys 14, supported by two infeed rollers 16, deflect the steel cable 12 over an angle of almost 90° in a lateral direction with respect to the wheel. The incoming and the outgoing sections of the steel cable 12 are thus showing in the direction of the engine room, which is located sideways of the wheel. Guide pulleys 17 are provided for deflection of the incoming and outgoing sections of the steel cable 12 in a direction of the drive pulley 11 in order to correlate the alignment of the incoming and outgoing sections of the steel cable and the drive pulley 11. Due to lateral deflection of the steel cable 12, the steel cable 12 does not cross downward nearby the cabins 6 at short distance and thus does not interfere with a passenger's look out of the cabins 6.

FIGS. 5 to 8 show another embodiment of an observation wheel according to the invention. Parts corresponding with those in FIGS. 1-4 are denoted by identical reference numerals and not explained again. The description below will center on the differences between the embodiments. In this embodiment, the observation wheel differs from the observation wheel of FIGS. 1 to 4 mainly in the design of the deflection means which are provided to lead the steel cable 12 away from the annular framework 3 of the wheel. While two deflection pulleys 14 are used with the observation wheel according to FIGS. 1 to 4, only one deflection wheel 14*a* is used with the observation wheel according to FIGS. 5 to 8. The deflection wheel 14*a* is used to simultaneously deflect both, the incoming and the outgoing sections of the steel cable 12. Accordingly, the deflection pulley 14*a* is provided with two parallel circumferential grooves 18*a*, in each of which either the incoming or the outgoing section of the steel cable 12 is guided.

While the observation wheel according to FIGS. 1 to 4 is provided with a single infeed roller 16 per deflection pulley 14, the observation wheel according to FIGS. 5 to 8 is provided with two infeed guiding devices 16*a*, each of which including a plurality of infeed rollers 16*b*. While one of the infeed guiding devices 16*a* aligns the incoming section of the steel cable 12 in that it engages securely in one of the two circumferential grooves 18*a* of deflection pulley 14*a*, the other one of the infeed guiding devices 16*a* correspondingly aligns the outgoing section of the steel cable 12 in order to securely engage in the other one of the circumferential grooves 18*a*.

The observation wheels according to the invention may also be provided with a double loop cable drive system as it is disclosed in principle in aforementioned European Patent Document EP 1 790 402 A1, where the drive cable runs on both sides along the circumference of the wheel, or with two single cable drive systems, one on either side of the wheel.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An observation wheel type ride, comprising:

a support structure;

a wheel rotatably mounted in said support structure and/or including transportation means, which are movably supported on the wheel;

a drive mechanism including a rotary drive and a drive cable, said drive cable being detachably fixed to a circumference of the wheel and/or the transportation means for transmitting a rotary movement of the rotary drive to the wheel and/or the transportation means; and deflection means for deflecting the drive cable in a lateral direction in relation to the wheel at a section which is led over the rotary drive.

2. The ride of claim 1, wherein the deflection means comprises at least one deflection pulley for deflecting the cable in a lateral direction with respect to the wheel.

3. The ride of claim 2, wherein the rotary drive has a drive pulley around which the drive cable is looped, said deflection means including two additional guide pulleys arranged between the deflection pulley and the drive pulley.

4. The ride of claim 3, wherein drive pulley is arranged in parallel relationship to the wheel.

5. The ride of claim 2, wherein the deflection pulley has two circumferential grooves for deflecting an incoming section and an outgoing section of the drive cable.

6. The ride of claim 1, wherein the deflection means includes a first deflection pulley for deflecting an incoming section of the drive cable and a second deflection pulley for deflecting the outgoing section of the drive cable.

7. The ride of claim 1, wherein the drive cable frictionally engages a circumference of the wheel and/or the transportation means.

8. The ride of claim 7, further comprising a plurality of cable shoes, distributed along the circumference of the wheel and/or on the transportation means, said drive cable frictionally engaging with the cable shoes.

9. An observation wheel type ride, comprising:

a support structure;

a wheel rotatably mounted in the support structure and having a plurality of passenger cabins in spaced-apart relationship about a circumference of the wheel;

a drive mechanism located at a distance to the wheel; and a force-transmitting mechanism operatively connected to the drive mechanism for transmitting a rotary movement, generated by the drive mechanism, to the wheel, said force-transmitting mechanism including a cable detachably secured to the circumference of the wheel and having a section routed to the side of the wheel in a direction of the drive mechanism.

10. The ride of claim 9, wherein the drive mechanism has a drive pulley around which the cable is looped to define an incoming cable section in the direction of the wheel and an outgoing cable section away from the wheel.

11. The ride of claim 10, wherein the force-transmitting mechanism includes two deflection pulleys positioned to effect a diverging course of the incoming and outgoing cable sections sideways.

12. The ride of claim 11 wherein the deflection pulleys deflect the incoming and outgoing cable sections by approximately 90°.

13. The ride of claim 11 wherein the deflection pulleys are positioned at an incline.

14. The ride of claim 11, wherein the force-transmitting mechanism includes two guide pulleys arranged between the deflection pulleys and the drive pulley for deflecting the incoming and outgoing cable sections.

15. The ride of claim 10, wherein the drive pulley is arranged in parallel relationship to the wheel.

16. The ride of claim 10, wherein the force-transmitting mechanism includes a deflection pulley positioned to effect a crossing pattern of the incoming and outgoing cable sections, as viewed from the drive mechanism.

17. The ride of claim 16, wherein the deflection pulley deflects the incoming and outgoing cable sections by approximately 90°.

18. The ride of claim 16, wherein the deflection pulley is positioned horizontally.

19. The ride of claim 16, wherein the force-transmitting mechanism includes two guide pulleys arranged between the deflection pulley and the drive pulley for deflecting the incoming and outgoing cable sections.

20. The ride of claim 16, wherein the deflection pulley has two circumferential grooves for deflecting the incoming and outgoing cable sections, respectively.

* * * * *

UNITED STATES PATENT AND TRADEMARK OFFICE

CERTIFICATE OF CORRECTION

PATENT NO. : 8,216,077 B2
APPLICATION NO. : 12/773385
DATED : July 10, 2012
INVENTOR(S) : Ronald Alexander Bussink et al.

It is certified that error appears in the above-identified patent and that said Letters Patent is hereby corrected as shown below:

Title Page item 56, Column 2, line 11, change "GB 06510 0/1909" to --GB 06510 9/1909--.

Signed and Sealed this
Twenty-eighth Day of August, 2012

David J. Kappos

David J. Kappos
*Director of the United States Patent and Trademark Office*